United States Patent [19]

Takahashi et al.

[11] Patent Number: 4,716,590

[45] Date of Patent: Dec. 29, 1987

[54] AM STEREO TRANSMISSION METHOD AND APPARATUS

[75] Inventors: Susumu Takahashi; Hiroshi Iida, both of Tokyo, Japan

[73] Assignee: Sansui Electric Co., Ltd., Tokyo, Japan

[21] Appl. No.: 691,793

[22] Filed: Jan. 16, 1985

[30] Foreign Application Priority Data

| | | | |
|---|---|---|---|
| Jan. 17, 1984 | [JP] | Japan | 59-6174 |
| Nov. 19, 1984 | [JP] | Japan | 59-176123[U] |
| Nov. 19, 1984 | [JP] | Japan | 59-176124[U] |
| Nov. 19, 1984 | [JP] | Japan | 59-176125[U] |

[51] Int. Cl.[4] ..... H04H 5/00

[52] U.S. Cl. ..... 381/15; 381/16

[58] Field of Search ..... 381/15, 16, 2

[56] References Cited

U.S. PATENT DOCUMENTS

| | | | |
|---|---|---|---|
| 4,172,966 | 10/1979 | Parker et al. | 381/15 |
| 4,192,968 | 3/1980 | Hilbert et al. | 381/15 |
| 4,406,922 | 9/1983 | Parker et al. | 381/15 |
| 4,489,431 | 12/1984 | Ecklund | 381/15 |

*Primary Examiner*—Forester W. Isen

*Attorney, Agent, or Firm*—Sughrue, Mion, Zinn, Macpeak & Seas

[57] ABSTRACT

This invention discloses an AM stereo transmission method characterized in that when left and right audio signals L and R are transmitted as an AM stereo signal which is represented by $S=A\cos(\omega t+\phi)$ wherein A denotes an amplitude, $\omega$ a carrier angular frequency and $\phi$ a phase angle given by $\tan^{-1}(L-R)/1+L+R$, the audio signal of low frequency is transmitted at an amplitude $A=(1+L+R)$, and the audio signal of high frequency is transmitted at an amplitude $A=\sqrt{(1+L+R)^2+(L-R)^2}$. The modulator according to the present invention comprises a matrix circuit for providing signals (L+R) and (L−R), an orthogonal modulator to produce an AM stereo signal $\sqrt{(1+L+R)^2+(L-R)^2}\cos(\omega t+\phi$, an amplitude controller, an amplitude control signal generator circuit and a low-pass filter. In the modulator the said AM stereo signal S is changed to the signal $(1+L+R)\cos(\omega t+\phi)$ for audio signal of low frequency by controlling the amplitude controller. The demodulator according to the present invention comprises an amplitude controller to which the AM signal $S=A\cos(\omega t+\phi)$ is inputted, an orthogonal demodulator, an matrix circuit for driving signals L and R from signals (L+R) and (L−R) obtained by the orthogonal demodulator, an amplitude control signal generator circuit and a low-pass filter. In the demodulator the said AM stereo signal $S=(1+L+R)\cos(\omega t+\phi)$ for audio signal of low frequency is changed to the signal $\sqrt{(1+L+R)^2+(L-R)^2}\cos(\omega t+\phi)$ by controlling the amplitude controller.

9 Claims, 14 Drawing Figures

AM STEREO TRANSMISSION METHOD AND APPARATUS

BACKGROUND OF THE INVENTION

1. Field of the Invention

The present invention relates to a method of transmitting AM stereo signals and, more particularly, it relates to method and apparatus for AM stereo transmission, excellently compatible with the conventional monaural receivers and with a narrow side-lobe frequency band.

2. Prior Art

Various methods have been proposed and used practically in the United States to achieve AM stereo transmission. None of these methods, however, are ideal from the viewpoint of their compatibility with conventional monaural receivers. One of these methods is to transmit a transmission signal S which is represented as follows:

$$S=(1+L+R)\cos(\omega t+\phi)$$

wherein L, R and $\omega$ represent left audio signal, right audio signal an carrier angular frequency, respectively, and $\phi$ is the phase angle given by $\tan^{-1}(L-R)/1+L+R$. When this signal S is received by the conventional monaural receiver, its envelope $(1+L+R)$ is detected. No distortion can be found in this detected signal, because only the sum signal which represents the monaural signal is present in it. Therefore, this transmission method is complete in its compatibility with the conventional monaural receivers. However, this signal S has such a drawback that a high frequency side-lobe causes the signal to occupy a wide band. FIG. 1A shows a frequency spectrum in a case where only the left signal of 8 KHz is modulated by 80% according to this method, and it is apparent from FIG. 1A that high frequency side-lobe is present.

Another method is to transmit a signal S which is represented as $$S=\sqrt{(1+L+R)^2+(L-R)^2}\cos(\omega t+\phi),$$

$$\phi=\tan^{-1}\frac{L-R}{1+L+R}.$$

Since the difference signal is present in the radical sign of this signal envelope, in addition to the sum signal which represents the monaural signal, distortion can be found in this envelope-detected signal. Therefore, this second method is not entirely compatible with the conventional monaural receivers. However, this signal S can be changed as follows:

$$S=(1+L+R)\cos\omega t-(L-R)\sin\omega t.$$

As is apparent from the above equation, it is composed of two AM waves, and no side-lobe higher than secondary degree is present accordingly. FIG. 1B shows a frequency spectrum in a case where only the left signal of 8 KHz is modulated by 80% according to this second method.

As described above, the first method causes no distortion when the signal is envelope-detected, and becomes excellently compatible with the conventional monaural receivers, but its side lobe causes it to occupy a wide band. On the contrary, the second method maintains the occupied band, as narrow as the conventional monaural AM signal, but it causes distortion when envelope-detected and it is inferior in its compatibility with the conventional monaural receivers. Therefore, neither of these methods is ideal for AM stereo transmission.

SUMMARY OF THE INVENTION

The object of the present invention is to provide an AM stereo transmission method wherein the frequency band occupied by the side-lobe can be kept substantially as narrow as in the conventional AM broadcasting and wherein excellent audibility can be achieved even when the signal is received by the conventional monaural receivers. The object of the present invention is also to provide a modulator and a demodulator for achieving the transmission method.

When left and right audio signals L and R are transmitted using an AM stereo signal, said AM stereo signal being represented by $S=A\cos(\omega t+\phi)$ wherein A denotes amplitude, $\omega$ the carrier angular frequency, and $\phi$ the phase angle $$\left(\tan^{-1}\frac{L-R}{1+L+R}\right),$$

it is characterized that transmission is carried out at an amplitude $A(=1+L+R)$ in relation to the audio signal of low frequency, and that transmission is carried out at an amplitude $A=[\sqrt{(1+L+R)^2+(L-R)^2}]$ in relation to the audio signal of high frequency.

FIG. 2A is a fundamental block diagram showing a modulator employed on the transmission side of the AM stereo transmission method according to the present invention. The modulator comprises a matrix circuit A for providing sum and difference signals (L+R) and (L−R) between the left and right audio signals L and R, an orthogonal modulator B for orthogonally modulating and composing these sum and difference signals to form an AM stereo signal $S=[\sqrt{(1+L+R)^2+(L-R)^2}\cos(\omega t+\phi)]$ wherein $\phi=\tan^{-1}(L-R)/1+L+R$, an amplitude controller C for changing the amplitude of this AM stereo signal S, a circuit (CGAC) E for generating an amplitude controlling signal to control this amplitude controller C and a low-pass filter D, and it is characterized in that the AM stereo signal S is made equal to the output of the orthogonal modulator B for high frequency audio signals and to $(1+L+R)\cos(\omega t+\phi)$ for low frequency audio signals by controlling the amplitude controller C with the control signal which has passed through the low-pass filter D receiving the signal from the CGAC.

FIG. 2B is a basic block diagram showing a demodulator employed on the reception side of the AM stereo transmission method according to the present invention. The demodulator comprises an amplitude controller F to which the transmitted AM stereo signal $S=(1+L+R)\cos(\omega t+\phi)$ or $S=\sqrt{(1+L+R)^2+(L-R)^2}\cos(\omega t+\phi)$ is inputted, an orthogonal demodulator I for orthogonally demodulating the output of this amplitude controller F, a matrix circuit J for deriving left and right audio signals L and R from sum and difference signals obtained from the orthogonal demodulator J, a circuit (CGAC) H for generating a signal to control the amplitude controller F, and a low-pass filter G, and it is characterized in that the input of the orthogonal demodulator I is the same as the input S for high frequency stereo signal and that $S=(1+L+R)\cos(\omega t+\phi)$ of the AM low frequency stereo signals is changed to $S=\sqrt{(1+L+R)^2+(L-R)^2}\cdot\cos(\omega t+\phi)$ by controlling the amplitude controller F with the control signal which has passed through the low-pass filter G receiving the signal from the CGAC H.

THE PREFERRED EMBODIMENT OF THE INVENTION

Figures 1A, 1B:
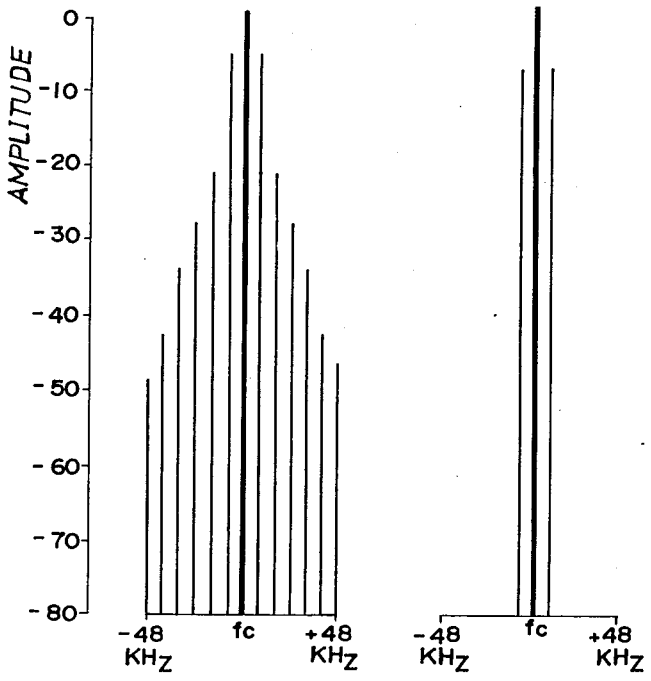
PRIOR ART FIG. 1(A)
FIGS. 1A and 1B are frequency spectrum diagrams showing the bands occupied by side-lobes according to two different transmission methods.
Figure 2:
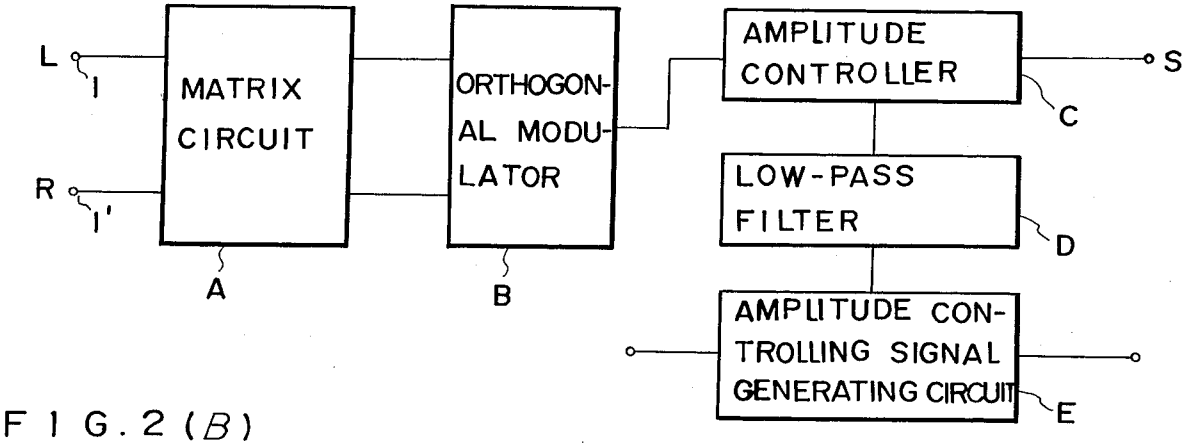
FIGS. 2A and 2B are fundamental block diagrams showing a modulator and a demodulator for attaining the transmission method of the present invention.
Figure 2:
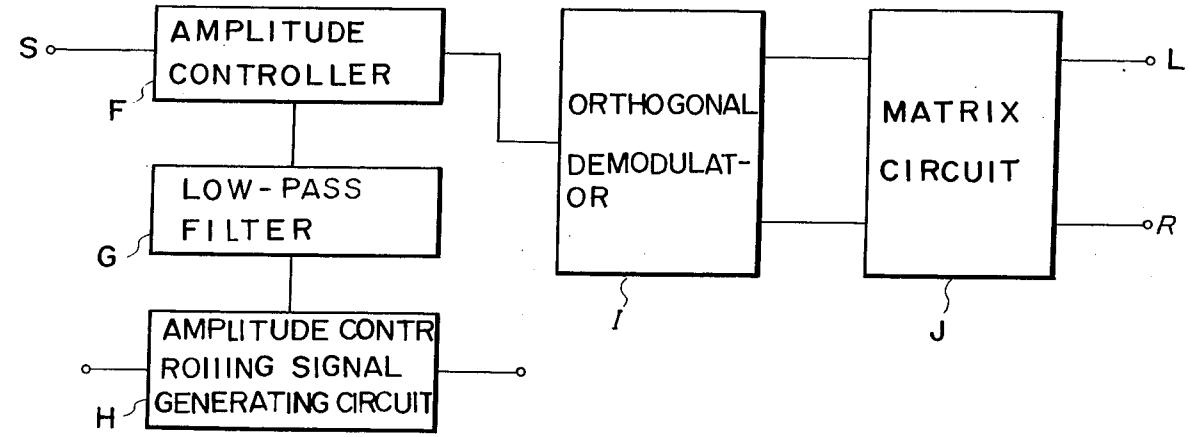
Figure 3:
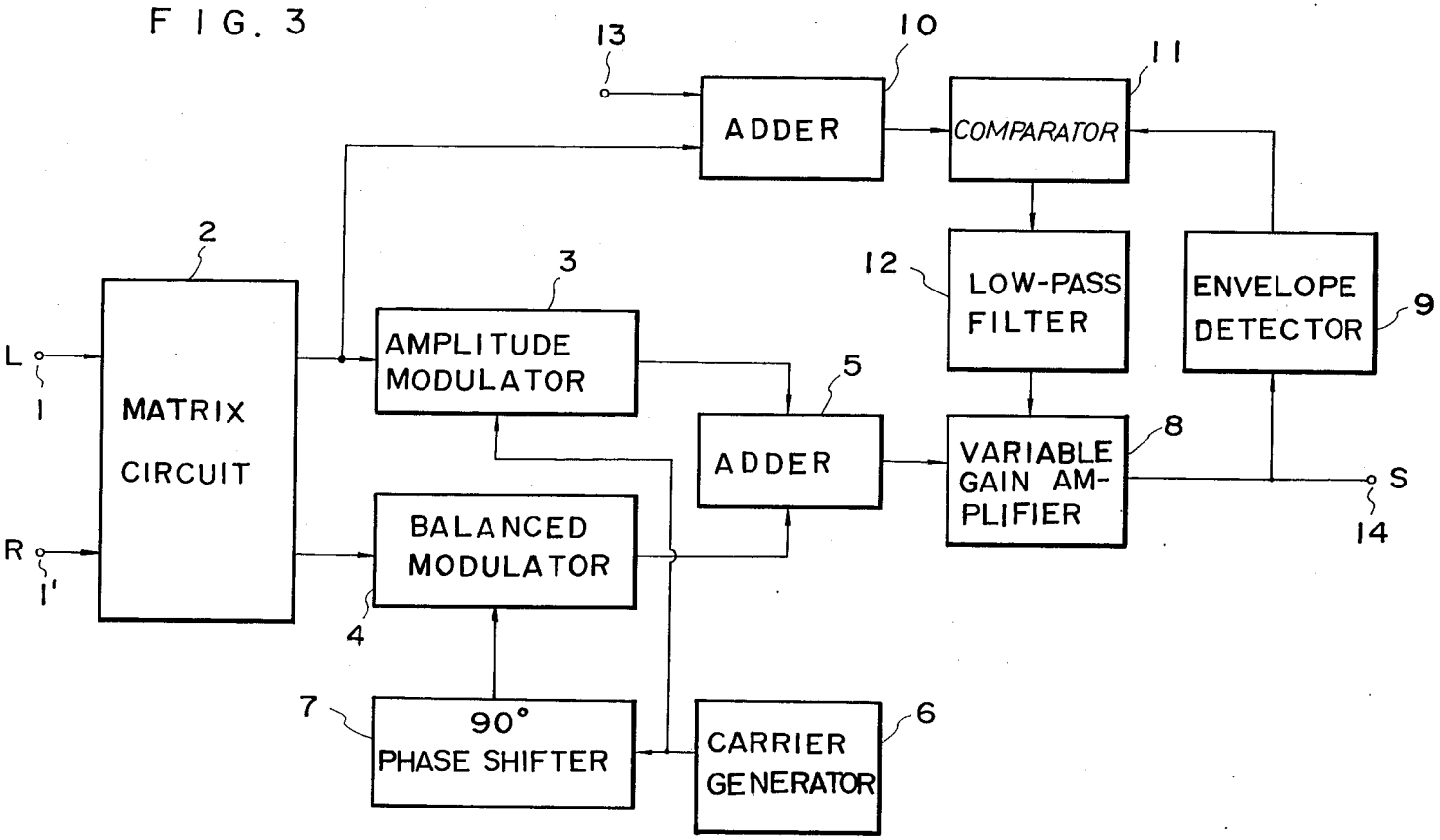
FIG. 3 is an example of the modulator for achieving the transmission method of the present invention.
Figure 9:
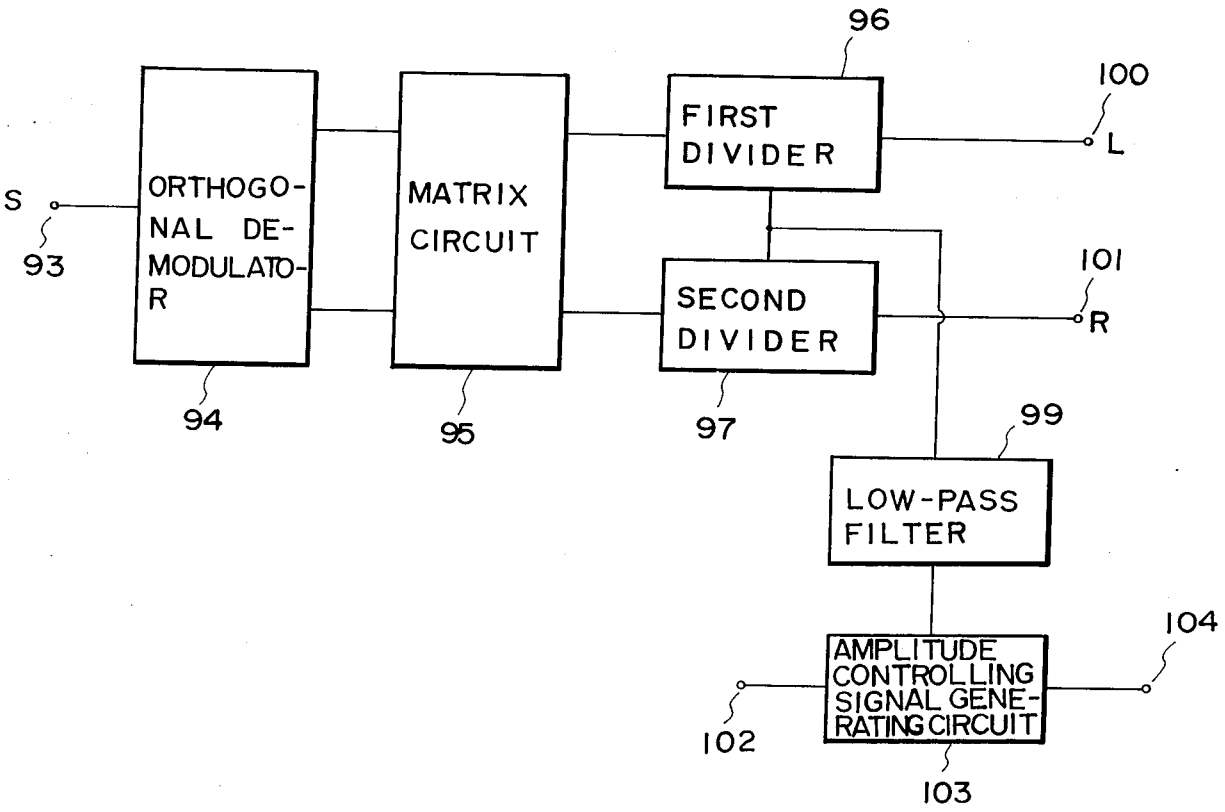
FIG. 9 shows a demodulator which carries out division after the matrix circuit.

FIG. 3 shows an example of the modulator used on the transmission side of an AM stereo transmission method according to the present invention. 1 and 1' represent input terminals to which left and right audio signals L and R are applied, 2 a matrix circuit for generating sum and difference signals (L+R) and (L−R) between the left and right audio signals L and R, 3 an amplitude modulator for changing the sum signal (L+R) to a modulated wave, 4 a balanced modulator for changing the difference signal (L−R) to a modulated wave, and 5 an adder for summing outputs of the amplitude and balanced modulators 3 and 4. 6 represents a carrier generator for generating and unmodulated carrier, and 7 a 90° phase shifter for phase-shifting the carrier by 90°. The orthogonal modulator circuit shown in FIG. 2A comprises the amplitude modulator 3, balanced modulator 4, adder 5, carrier generator 6 and 90° phase shifter 7. 8 denotes a variable gain amplifier which corresponds to the amplitude controller C in FIG. 2A 9 represents an envelope detector for detecting the output envelope of the variable gain amplifier 8. 10 represents an adder for combining a DC bias voltage (=1) inputted to a terminal 13 and the sum signal (L+R) produced through the matrix circuit 2, and 11 a comparator for comparing the output of the adder 10 with the output of the envelope detector 9. 12 denotes a low-pass filter through which low frequency components of the output of the comparator 11 are allowed to pass. The amplitude control signal generating circuit (CGAC) shown in FIG. 2A comprises the envelope detector 9, adder 10 and comparator 11. 14 represents an output terminal through which the AM stereo signal is outputted. The modulator arranged as described above is operated as follows:

The left and right audio signals L and R provided to the input terminals 1 and 1' are added and subtracted to form sum and difference signals (L+R) and (L−R). The sum signal (L+R) is modulated to a signal (1+L+R) cos ωt by means of the amplitude modulator 3, while the difference signal (L−R) is modulated to a signal −(L−R) sin ωt by means of the balanced modulator 4. Namely, orthogonal modulation is conducted. In this case, the carrier cos ωt is generated by the carrier generator 6 and inputted to the amplitude modulator 3, while it is phase-shifted by 90° by the 90° phase shifter 7 and inputted, as −sin ωt, to the balanced modulator 4. The output of the adder 5 receiving the inputs of amplitude modulator 3 and balanced modulator 4 is represented by the following AM stereo signal:

$$S=(1+L+R)\cos\omega t-(L-R)\sin\omega t \quad (1)$$

$$=\sqrt{(1+L+R)^2+(L-R)^2}\cos(\omega t+\phi)$$

$$=A\cos(\omega t+\phi),$$

wherein $$\phi=\tan^{-1}\frac{L-R}{1+L+R}.$$

The signal S is introduced to an output terminal 14 through the variable gain amplifier 8 and envelope-detected by the envelope detector 9 at the same time. Therefore, the output of the envelope detector 9 becomes A in the equation (1). The sum signal (L+R) of the matrix circuit 2 is inputted into the adder 10 with another input bias "1" through a terminal 13 to obtain (1+L+R).

The output (1+L+R) of the adder 10 and the output A of the envelope detector 9 are inputted into the comparator 11 where they are compared. The output of the comparator 11 is an error signal between (1+L+R) and A, and when the frequency of this error signal, that is, the frequency of left and right audio signals is low, the error signal passes through the low-pass filter 12 to control the variable gain amplifier 8 until the error signal becomes zero by changing the gain. When the error signal is zero, the amplitude is given by A=(1+L+R), and an AM stereo signal which is represented by $$S=(1+L+R)\cos(\omega t+\phi). \quad (2)$$

can be obtained at the output terminal 14.

When the frequency of the error signal, or left and right audio signals is high, no audio output is passed through the low-pass filter 12 a DC component is outputted therefrom, keeping the variable gain amplifier 8 not controlled, and the output of the adder 5 appears, as it is, at the output terminal 14. Namely, $$S = \sqrt{(1 + L + R)^2 + (L - R)^2}\ \cos(\omega t + \phi). \quad (3)$$

The AM stereo signal of the output terminal 14 is broadcasted as an electric wave.

To summarize the above description, the transmitted AM stereo signal S transmitted can be expressed, in the case of audio signals of low frequency, by $$S=(1+L+R)\cos(\omega t+\phi), \quad (4)$$

while the transmitted AM stereo signal S can be expressed, in the case of audio signals of high frequency, by $$S = \sqrt{(1 + L + R)^2 + (L - R)^2}\ \cos(\omega t + \phi). \quad (5)$$

Providing that a cut-off frequency of the low-pass filter 12 is 3 KHz, the transmitted signal S can be represented by the equation (4) when audio signals are less than 3 KHz. This signal has no distortion and is compatible with the conventional monaural receivers even when it is received by the conventional monaural receivers.

Although a high-frequency side-lobe is present, the highest frequency of the tertiary side-lobe is 9 KHz and most of the signal energy is concentrated less than 9 KHz.

Audio signals higher than 3 KHz are transmitted using the signal S which is represented by the equation (5), but since the side-lobe of this signal is only primary, no side-lobe higher than 10 KHz is present, providing that the highest audio frequency is 10 KHz. When it is assumed that most of the energy of the signal represented by the equation (4) can be transmitted below the highest frequency 9 KHz of the tertiary side-lobe, therefore, the band occupied may be 10 KHz. This is the same as that in the case of the conventional monaural AM broadcasting. Although the signal represented by the equation (5) causes distortion when is is envelope-detected by the conventional monaural receivers, the audio frequency is higher in this case than 3 KHz. Therefore, most of higher harmonics are excluded from the band, thereby causing no problem in audibility.

Figure 4:
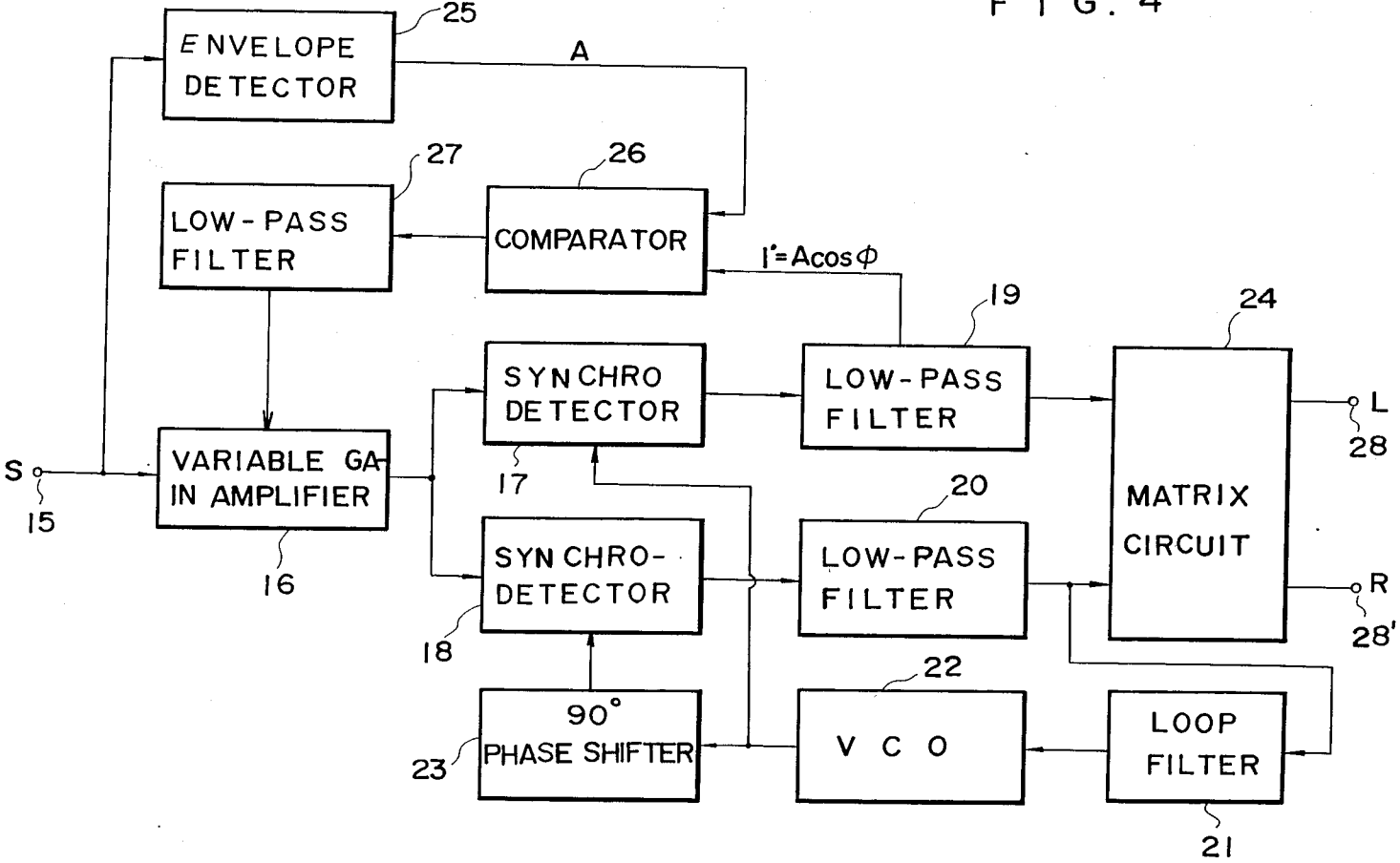
FIG. 4 is an example of the demodulator for achieving the transmission method of the present invention.

FIG. 4 shows an example of the demodulator used on the reception side of the AM stereo transmission method according to the present invention. Numeral 15 represents an input terminal to which the transmitted signal S is inputted, and 16 a variable gain amplifier which corresponds to the amplitude controller in FIG. 2B. Numerals 17 and 18 denote synchro-detectors, 19, 20 low-pass filters, 21 a loop filter for detecting a DC component from the output of the low-pass filter 20, 22 a voltage controlled oscillator for generating carrier for demodulation which is used at the time of synchro-detection, and 23 a 90° phase shifter for phase-shifting the output of the voltage control oscillator 23. The synchro-detector 18, low-pass filter 20, loop filter 21, voltage controlled oscillator 22 and 90° phase shifter 23 form a PLL circuit as well as a synchro-detector circuit. The PLL circuit, synchro-detector 17, and low-pass filter 19 form the orthogonal demodulator shown in FIG. 2B. Numeral 24 denotes a matrix circuit for separating left and right audio signals L and R from the outputs of the low-pass filters 19 and 20. Numerals 28 and 28' denote output terminals for the left and right audio signals L and R. 25 represents an envelope detector for detecting the envelope of the transmitted signal S. 26 denotes a comparator for comparing the output of the envelope detector 25 with the output of the low-pass filter 19, and 27 denotes a low-pass filter through which the low frequency component of the output of the comparator 26 is allowed to pass to control the variable gain amplifier 16.

The envelope detector 25 and comparator 26 form the amplitude control signal generator circuit (CGAC) shown in FIG. 2B.

As will be described later, the difference signal (L−R) is obtained through the low-pass filter 20, but when the carrier of the transmitted signal S is shifted in phase from the carrier which is the output of the voltage controlled oscillator 22 which synchro-detects the signal S, DC a component is outputted through the low pass filter 20, in addition to the difference signal (L−R). The loop filter 21 allows this DC component to pass therethrough, and the voltage controlled oscillator is controlled by this DC voltage to generate a carrier B cos ωt, having same the phase as the carrier of the signal S.

This carrier B cos ωt is inputted to the synchro-detector 17 while it is added, as B sin ωt, to the synchro-detector 18 through the 90° phase shifter 23.

Providing that the AM stereo signal $S(=A\cos(\omega t+\phi))$ is added to the input terminal 15 and outputted, as it is, through the variable gain amplifier 16, this signal S is multiplied by the carrier B cos ωt at the synchro-detector 17 and by the carrier B sin ωt at the synchro-detector 18. Let B=2, then respective outputs I and Q are denoted by $$I = A\cos(\omega t + \phi)\,2\cos\omega t \quad (6)$$

$$= A(\cos\phi + \cos\phi\cos 2\omega t - \sin\phi\sin 2\omega t)$$

and $$Q = A\cos(\omega t + \phi)\,2\sin\omega t \quad (7)$$

$$= A(\cos\phi\sin 2\omega t - \sin\phi + \sin\phi\cos 2\omega t).$$

When these are passed through the low-pass filters 19 and 20, respectively, the outputs are given by $$I' = A\cos\phi, \quad (8)$$

$$Q' = -A\sin\phi. \quad (9)$$

Since $$\phi = \tan^{-1}\frac{L - R}{1 + L + R},$$

$$\cos\phi = \frac{1 + L + R}{\sqrt{(1 + L + R)^2 + (L - R)^2}}, \quad (10)$$

$$\sin\phi = \frac{L - R}{\sqrt{(1 + L + R)^2 + (L - R)^2}}. \quad (11)$$

The envelope detector 25 detects the envelope of the signal S and its output is denoted by A. This output A and the output $I'(=A\cos\phi)$ of the low-pass filter 19 are inputted to the comparator 26 where they are compared with each other. The output of the comparator 26 is an error signal between A cos φ and A, and when the frequency of this error signal or of left and right audio signals is low, the error signal passes through the low-pass filter 27 to control the variable gain amplifier 16 and change the amplitude A of the signal S in such a way that the error signal becomes zero. Providing that the changed amplitude is A', the output of the variable gain amplifier 16 is A' cos ($\omega t+\phi$). Therefore, outputs I' and Q' of the low-pass filters 19 and 20 can be represented as follows:

$$I'=A' \cos \phi, \tag{12}$$

$$Q'=-A' \sin \phi. \tag{13}$$

When the error signal becomes zero, A=A' cos $\phi$. Therefore, $$A'A=A/\cos \phi. \tag{14}$$

When the audio signal frequency is low, the AM stereo signal S transmitted can be expressed as follows, as already described about the modulator:

$$S = A \cos (\omega t + \phi) \tag{15}$$

$$= (\perp + L + R) \cos (\omega t + \phi).$$

and $A=(1+L+R)$. When the equation (14) is replaced by this A and cos $\phi$ of the equation (10), $$A' = \sqrt{(1 + L + R)^2 + (L - R)^2}\ . \tag{16}$$

and the amplitude (1+L+R) of the signal S transmitted is changed to $$\sqrt{(1 + L + R)^2 + (L - R)^2}$$

Therefore, outputs I' and Q' of the low-pass filters 19 and 20 become:

$$I'=A' \cos \phi=(1+L+R), \tag{17}$$

$$Q'=-A' \cos \phi=-(L-R). \tag{18}$$

and these outputs are added and subtracted through the matrix circuit 24 after DC the component is removed therefrom, and they are separated to left and right audio signals L and R which are supplied to the output terminals 28 and 28', respectively.

In a case where the audio signal frequency is high, the signal S transmitted can be expressed as follows:

$$S = \sqrt{(1 + L + R)^2 + (L - R)^2}\ \cos(\omega t + \phi). \tag{19}$$

It is assumed that this signal S is inputted through the input terminal 15 and outputted, as it is, through the variable gain amplifier 16, the outputs I' and Q' of the low pass filters 19 and 20 can be derived from the equations (8) and (9) as follows:

$$I'=(1+L+R), \tag{20}$$

$$Q'=-(L-R). \tag{21}$$

The equation (20) $I'=(1+L+R)$ and the output $\sqrt{(1+L+R)^2+(L-R)^2}$ obtained when the signal S expressed by the equation (19) is detected by the envelope detector 25 are compared with each other by the comparator 26 to output an error signal. Since the frequency of this error signal is high, however, no audio output is generated through the low-pass filter 27, and a DC component is outputted therefrom. Therefore, the variable gain amplifier 16 is not controlled and the amplitude of the signal S is not changed, so that the outputs of the low-pass filters 19 and 20 are left as expressed as the equations (20) and (21). These outputs are added and subtracted through the matrix circuit 24 after the DC component is removed therefrom, and they are separated into left and right audio signals L and R, which are supplied to the output terminals 28 and 28'.

Demodulation of AM stereo signal which is transmitted in the form of $S=(1+L+R) \cos (\omega t+\phi)$ relative to the audio signal of low frequency and in the form of $S=\sqrt{(1+L+R)^2+(L-R)^2} \cos (\omega t+\phi)$ relative to the audio signal of high frequency can be achieved as described above.

Figure 5:
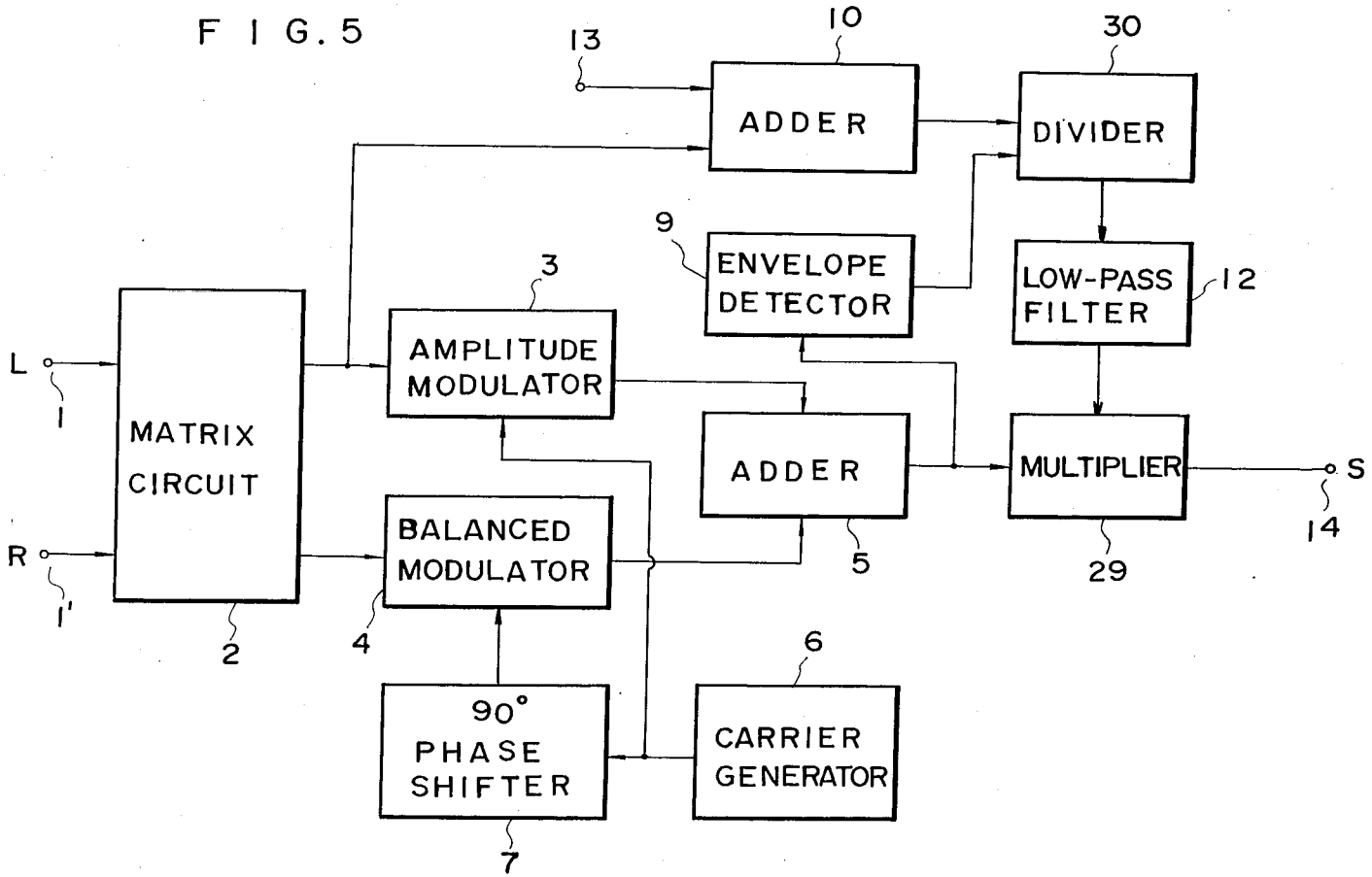
FIG. 5 is another example of the modulator.

FIG. 5 shows another example of the modulator used on the transmission side of the AM stereo transmission method according to the present invention. Description will be made leaving the same reference numerals affixed to the same parts as those in FIG. 3, and this example in FIG. 5 is different from the one shown in FIG. 3 in that the variable gain amplifier 8 is replaced by a multiplier 29 and in that the amplitude control signal generator circuit (CGAC) comprises the envelope detector 9, adder 10 and divider 30.

Operations of the matrix circuit 2 and orthogonal modulator circuit which comprises the amplitude modulator 3, balanced modulator 4, adder 5, carrier generator 6 and 90° phase shifter 7 are similar to that in FIG. 3. Therefore, the AM stereo signal S outputted from the adder 5 can be expressed as follows:

$$S = \sqrt{(1 + L + R)^2 + (L - R)^2}\ \cos(\omega t + \phi). \tag{22}$$

The amplitude $\sqrt{(1+L+R)^2+(L-R)^2}$ of this signal S is detected by the envelope detector 9 and inputted into the divider 30. Applied to another input of the divider 30 is output of the adder 10 which is equal to (1+L+R) in FIG. 3. Output C of the divider 30 is as follows:

$$C = \frac{1 + L + R}{\sqrt{(1 + L + R)^2 + (L - R)^2}} \tag{23}$$

When the aural signal frequency is low, this output C is passed through the low-pass filter 12 and inputted to the multiplier 29 where the equations (22) and (23) are multiplied each other, and the following AM stereo signal S can be obtained through the output terminal 14:

$$S=(1+L+R) \cos (\omega t+\phi). \tag{24}$$

When the audio signal frequency is high, no audio output is generated through the low-pass filter 12 and a DC component is outputted therefrom, and the output of the adder 5 is supplied, as it is, to the output terminal 14. Namely, the AM stereo signal S transmitted is as follows:

$$S = \sqrt{(1 + L + R)^2 + (L - R)^2}\ \cos(\omega t + \phi). \tag{25}$$

The output (1+L+R) of the adder 10 can be obtained by envelope-detecting the output of amplitude modulator 3. The output $\sqrt{(1+L+R)^2+(L-R)^2}$ of the envelope detector 9 may be obtained by passing the sum of the squares of one output (L−R) of the matrix circuit and the output (1+L+R) of the adder 10 through a square root circuit. Or since the output of the divider 30 can be expressed by cos $\phi$ the output of the adder 5 may be passed through a limiter and multiplied by the output of the carrier generator 6, keeping its amplitude certain.

Figure 6:
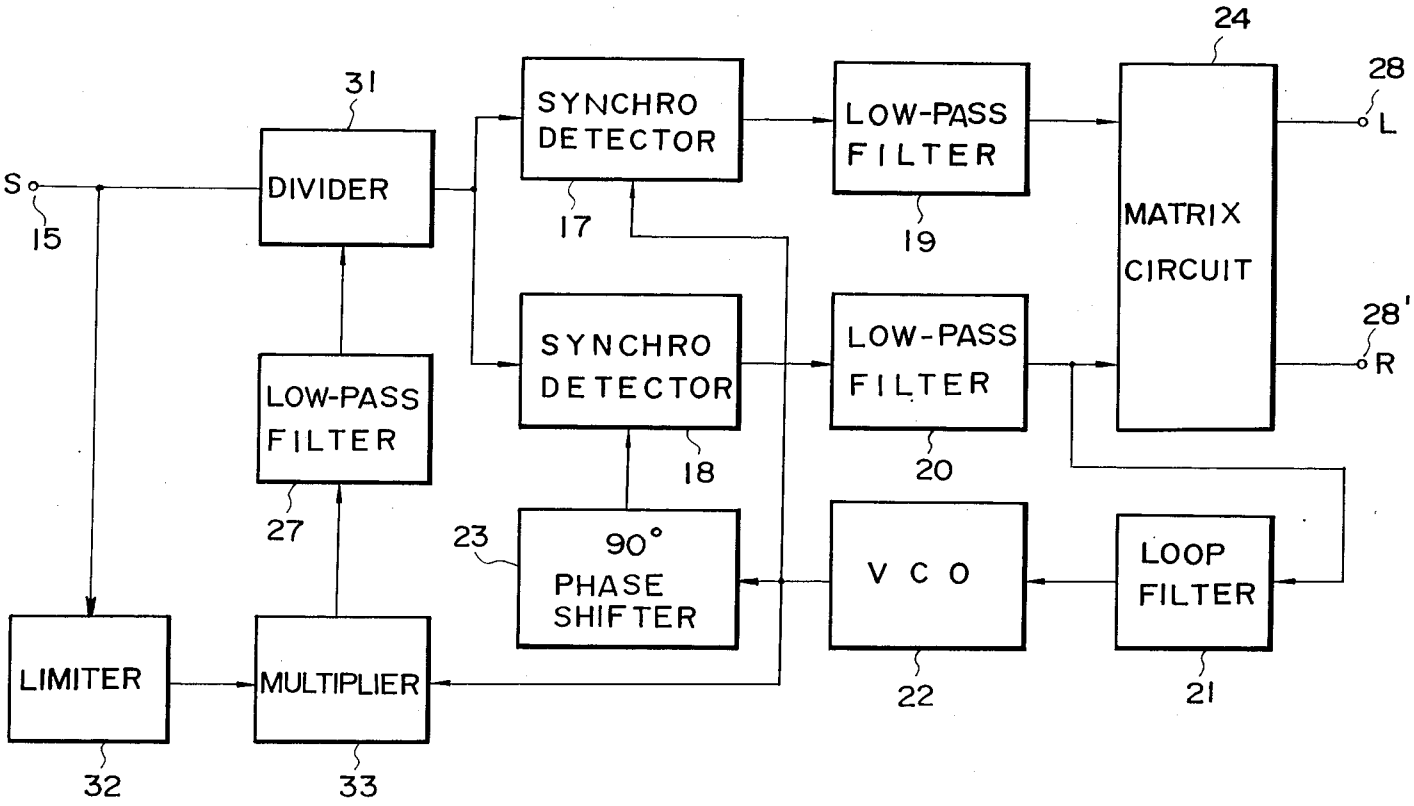
FIG. 6 shows another example of the demodulator.

FIG. 6 shows another example of the demodulator used on the reception side of the AM stereo transmission method according to the present invention.

Description on this example will be made leaving the same reference numerals affixed to the same parts as those in FIG. 4. This example is different from the one shown in FIG. 4 in that the variable gain amplifier 14 is replaced by a divider 31 and in that the amplitude control signal generator circuit (CGAC) comprises a limiter 32 and a multiplier 33.

Operations of the matrix circuit 24 and orthogonal demodulator which comprises the synchro-detectors 17, 18, low-pass filters 19, 20, loop filter 21, voltage controlled oscillator 22 and 90° phase shifter 23 are similar to those in FIG. 4. The AM stereo signal S transmitted is as follows:

$$S = A\cos(\omega t + \phi) = (1 + L + R)\cos(\omega t + \phi), \quad (26)$$

or $$S = \sqrt{(1 + L + R)^2 + (L - R)^2}\cos(\omega t + \phi). \quad (27)$$

This signal S is added to the input terminal 15 and orthogonally demodulated through the divider 31 while added to the limiter 32. The output of the limiter 32 is inputted into the multiplier 33 as a signal K cos ($\omega t+\phi$) where in its amplitude K represents a constant. Carrier B cos $\omega t$ which is the output of the voltage controlled oscillator 22 is also inputted to the multiplier 33 and multiplied by the output of the limiter 32. As a result, the output D of the multiplier 33 is as follows:

$$D = KB\cos(\omega t+\phi)\cos\omega t \quad (28)$$

If it is assumed that KB=2, equation (28) is given by $$D = \cos\phi + \cos\phi\cos 2\omega t - \sin\phi\sin 2\omega t \quad (29)$$

When the audio signal frequency of the AM stereo signal S transmitted is low, only cos $\phi$ is added to the divider 31 by passing this output D through the low-pass filter 27 which is same in characteristic as the low-pass filter 12 shown in FIGS. 3 or 5. Since the audio signal frequency is low this time, the AM stereo signal S transmitted is given by $$S = (1+L+R)\cos(\omega t+\phi) \quad (30)$$

where $$\cos\phi = \frac{1 + L + R}{\sqrt{(1 + L + R)^2 + (L - R)^2}} \quad (31)$$

Therefore, the output of the divider 31 becomes the following signal S which is derived from dividing the equation (30) by the equation (31). Namely, $$S = \sqrt{(1 + L + R)^2 + (L - R)^2}\cos(\omega t + \phi) \quad (32)$$

This signal S is demodulated, as expressed by the equations (17) and (18), by means of the subsequent orthogonal detector circuit, added and subtracted after the DC component is removed therefrom by means of the matrix circuit 24, and separated into left and right audio signals L and R, which are supplied to the output terminals 28 and 28'.

As the frequency of a signal becomes higher, its process becomes more difficult. Therefore, the following are examples wherein amplitude is controlled at low frequency and not controlled at a carrier frequency.

Figure 7:
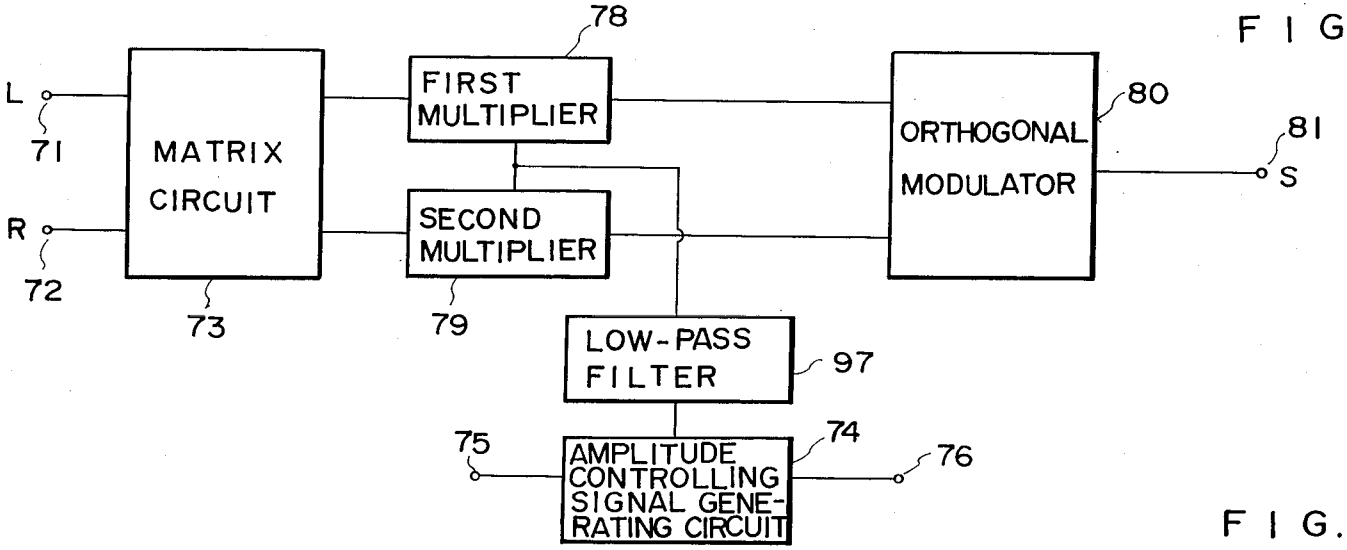
FIG. 7 shows a modulator wherein first and second multipliers which are the amplitude controllers are arranged between the matrix circuit and the orthogonal modulator to carry out multiplication with an audio signal.

FIG. 7 shows an example of a modulator which is enabled to control an amplitude by changing a high frequency band to a lower band according to the present invention. 71 and 72 represent input terminals to which left and right audio signals L and R are applied, 73 is the matrix circuit for generating sum and difference signals (1+L+R) and (L−R), 74 is the amplitude control signal generating circuit (CGAC) which generates an amplitude control signal to be multiplied by the sum (1+L+R) and the difference (L−R), 77 is the low-pass filter which is enabled to pass the low frequency part of the said amplitude control signal, 78 is the first multiplier in which the said sum signal (1+L+R) is multiplied by the said amplitude control signal, 79 is the second multiplier in which the said difference signal (L−R) is multiplied by the said amplitude control signal, 80 is the orthogonal modulator which is enabled to modulate the outputs of the first and second multipliers orthogonally and to make a carrier with modulated and suppressed amplitude, and 81 is the output terminal for transmitting the AM stereo signal S.

The left and right audio signals L and R which are inputted from input terminals 71 and 72 are changed to the sum and difference signals (1+L+R) and (L−R) in the matrix circuit 73. The inputs 75 and 76 of the CGAC 74 receive the sum and difference signals (1+L+R) and (L−R) which are generated, for examwple, from outputs of the matrix circuit 73, respectively. The CGAC 74 which contains a circuit with calculations of the square root of a sum of squares and the divider receives the signals of the inputs 75 and 76, and outputs the amplitude control signal as $$\frac{1 + L + R}{\sqrt{(1 + L + R)^2 + (L - R)^2}} = \cos\phi. \quad (33)$$

When the frequency of left and right audio signals is low, the said amplitude control signal cos $\phi$, which can pass through the low-pass filter 27, is multiplied by the sum signal (1+L+R) inputted into the first multiplier and also by the difference signal (L−R) inputted into the second multiplier. As a result, the outputs of the first and second multipliers become (1+L+R) cos $\phi$ and (L−R) cos $\phi$, respectively. In the orthogonal modulator 80, the said signals (1+L+R) cos $\phi$ and (L−R) cos $\phi$ are modulated and summed orthogonally to be a carrier with modulated and suppressed amplitude. The AM stereo signal S which is outputted from the output terminal 81 is given by $$S = \cos\phi\,\{(1 + L + R)\cos\omega t - (L - R)\sin\omega t\} \quad (34)$$

-continued $$= \cos\phi \cdot \sqrt{(1 + L + R)^2 + (L - R)^2} \cdot \cos(\omega t + \phi)$$

$$= (1 + L + R) \cos(\omega t + \phi).$$

When the frequency of the left and right audio signals L and R is high, the amplitude control signal cos $\phi$ is removed by the low-pass filter 77 and the filter output is a DC component. Therefore, the outputs of the first and second multipliers are the sum and difference signals (1+L+R) and (L−R) respectively. In the orthogonal modulator 80, these signals are modulated and summed orthogonally to provide a carrier with modulated and suppressed amplitude. As a result, the AM stereo signal S which is outputted from the output terminal 81 is given by $$S = \sqrt{(1 + L + R)^2 + (L - R)^2} \cos(\omega t + \phi). \quad (35)$$

As described above, since the audio signal S which is given by equation (34) for low frequency or by equation (35) for high frequency is transmitted as an AM stereo signal, the transmission method is the same as the method of the present invention described before.

Figure 8:
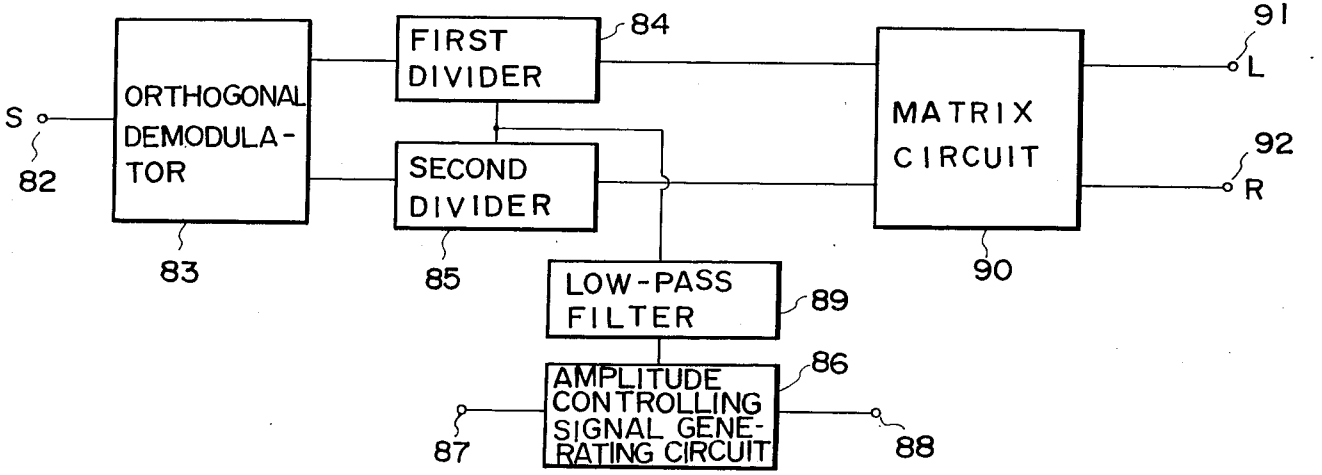
FIG. 8 shows a demodulator wherein first and second dividers are arranged between the orthogonal demodulator and the matrix circuit to carry out division with an audio signal.

FIG. 8 shows an example of demodulator for controlling an amplitude by changing a high frequency band to a lower band according to the present invention. In the figure, 82 represents the input terminal to receive the signal S, 83 is the orthogonal demodulator, 84 and 85 are the first and second dividers in which the demodulated signals are divided by the amplitude control signal, 86 is the amplitude control signal generating circuit (CGAC) which enables generation of an amplitude control signal inputting to the first and second dividers 84 and 85, 89 is the low-pass filter which passes the lower frequency part of the amplitude control signal, 90 is the matrix circuit which adds and subtract the outputs of the first and second dividers, respectively, and 91 and 92 are the output terminals from which the left and right audio signals L and R are outputted.

When the frequencies of the left and right audio signals L and R are low, the signal S represented by equation (34) is inputted to the input terminal 82. On the other hand, when the frequencies of the left and right audio signals L and R are high, the signal S represented by equation (35) is inputted to the terminal 82. To one of the input terminals of the CGAC 86, the signal given by cos ($\omega t+\phi$) is inputted. This signal is obtained, for example, from the output of the limiter receiving the signal $S=A \cos(\omega t+\phi)$ which is inputted from the input terminal 82. The another input terminal 88 receives the signal cos $\omega t$ which is generated from, for example, the carrier generator used in demodulation. The said two signals which are inputted to the input terminals of the CGAC are multiplied by each other and the frequency part being higher than the carrier angular frequency $\omega$ is removed. As the result, the amplitude control signal cos $\phi$ is outputted from the CGAC.

When the frequency of the left and right audio signals L and R is low, the signal S inputted at the input terminal 82 is (1+L+R) cos ($\omega t+\phi$). In the orthogonal demodulator 83, the signal S is demodulated orthogonally by the carriers cos $\omega t$ and sin $\omega t$, and then the demodulated signals represented by (1+L+R) cos $\phi$ and (L−R) cos $\phi$ are outputted from the orthogonal demodulator 83. The demodulated signals are inputted to the first and second dividers, respectively. The amplitude control signal cos $\phi$ which is passed through the low-pass filter 89 is inputted to the first and second dividers 84 and 85. Therefore, the signals (1+L+R) and (L−R) are outputted from the first and second dividers 84 and 85, because the signals (1+L+R) cos $\phi$ and (L−R) cos $\phi$ are divided by cos $\phi$, respectively. These signals from the dividers are summed and subtracted in the matrix circuit 90 and the left and right audio signals L and R are outputted from the output terminals 91 and 92.

When the frequency of left and right audio signals L and R is high, the signal S inputted at the input terminal 82 is given by $\sqrt{(1+L+R)^2+(L-R)^2}$. cos ($\omega t+\phi$) and then the signals (1+L+R) and (L−R) are demodulated by means of orthogonal demodulation in the orthogonal demodulator 83. The amplitude control signal cos $\phi$ is removed by the low-pass filter 89 and the output signal of the filter is a DC component. Therefore, the output signals of the orthogonal demodulator are inputted, as is, to the matrix circuit 90 to be summed and subtracted, and the left and right audio signals L and R are outputted from the output terminals 91 and 92, respectively. As described above, the AM stereo signal S is demodulated.

Also, as shown in FIG. 9, the first and second dividers 96 and 97 in the demodulator can be placed on the side of the outputs of the matrix circuit 95. In that case, when the outputs of the orthogonal demodulator 94 are (1+L+R) cos $\phi$ and (L−R) cos $\phi$ the inputs of the first and second dividers 96 and 97 are L cos $\phi$ and R cos $\phi$, respectively, and then each cos $\phi$ is removed by the dividers, and the left and right audio signals L and R are outputted from the output terminals 100 and 104.

Consequently, according to the present invention methods shown in the examples of FIGS. 7, 8 and 9, because the first and second multipliers in the modulator and the first and second dividers in the demodulator are placed on the input side of the orthogonal modulator and on the output side of the orthogonal demodulator, respectively, low frequency signals can be used.

As described before, FIG. 7 shows a modulator wherein first and second multipliers which are amplitude controllers are arranged between the matrix circuit and the orthogonal modulator to carry out multiplication with audio signals. FIG. 8 shows a demodulator wherein first and second dividers are arranged between the orthogonal demodulator and the matrix circuit to carry out division with audio signal. FIG. 9 shows a demodulator which carries out division after the matrix circuit.

Figure 10:
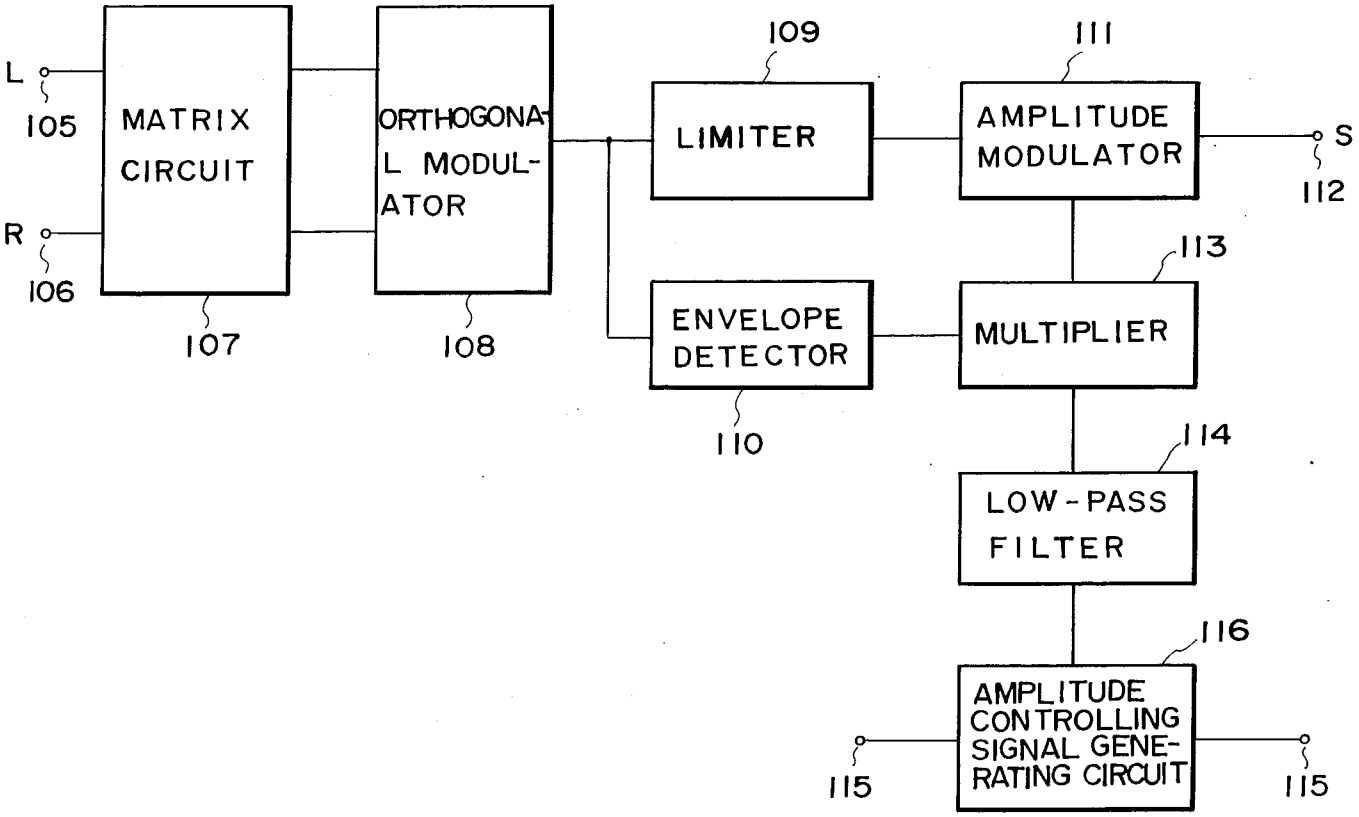
FIG. 10 shows a modulator wherein envelope detection is carried out after orthogonal modulation to remove the carrier from the audio signal, thereby enabling multiplication to be conducted with the audio signal, and amplitude modulation is then carried out again.

The following is also an example wherein amplitude is controlled at low frequency. FIG. 10 shows a modulator wherein envelope detection is carried out after orthogonal modulation to remove the carrier from the audio signal, thereby enabling multiplication to be conducted with the audio signal, and amplitude modulation is then carried out again.

The operations of the matrix circuit 107, the orthogonal modulator 108 and the amplitude control signal generator circuit (CGAC) 116 are the same as those of the modulator shown in FIG. 2A. Therefore, the output of the orthogonal modulator 108 is given by $$\sqrt{(1 + L + R)^2 + (L - R)^2} \cos(\omega t + \phi) \quad (36)$$

and the outputs of the low-pass filter 114 are cos $\phi$ and the DC component for the audio signals with low and high frequencies, respectively. The output of the orthogonal modulator 108 is inputted to the envelope detector 110 and the limiter 109. The envelope signal $\sqrt{(1+L+R)^2+(L-R)^2}$ is outputted from the envelope detector 110 and cos $(\omega t+\phi)$ which has a constant amplitude is outputted from the limiter 109. This cos $(\omega t+\phi)$ is a phase-modulated signal by $\phi=\tan(L-R)/1+L+R$ and is used as a carrier by inputting to the amplitude modulator 111.

When the frequency of left and right audio signals is low, the output signal $\sqrt{(1+L+R)^2+(L-R)^2}$ of the envelope detector 110 and the output cos $\phi$ of the low-pass filter 114 are multiplied in the multiplier 113, and the output of the multiplier 113 becomes a signal (1+L+R). This signal (1+L+R) is inputted to the amplitude modulator 111 which performs the amplitude modulation for the carrier cos $(\omega t+\phi)$. Therefore, the AM stereo signal outputted from the output terminal 112 is given by $$S=(1+L+R)\cos(\omega t+\phi). \tag{37}$$

On the other hand, when the frequency of the left and right audio signals L and R is high, the output signal of the low-pass filter 114 is a DC component and then the modulating signal for the carrier cos $(\omega t+\phi)$ is the same as the output signal of the envelope detector 110. Therefore, the AM stereo signal outputted from the output terminal 112 is given by $$S=\sqrt{(1+L+R)^2+(L-R)^2}\cos(\omega t+\phi). \tag{38}$$

Consequently, by means of this example according to the present invention, a low frequency band can be used because the amplitude control is performed after the envelope detection.

Figure 11:
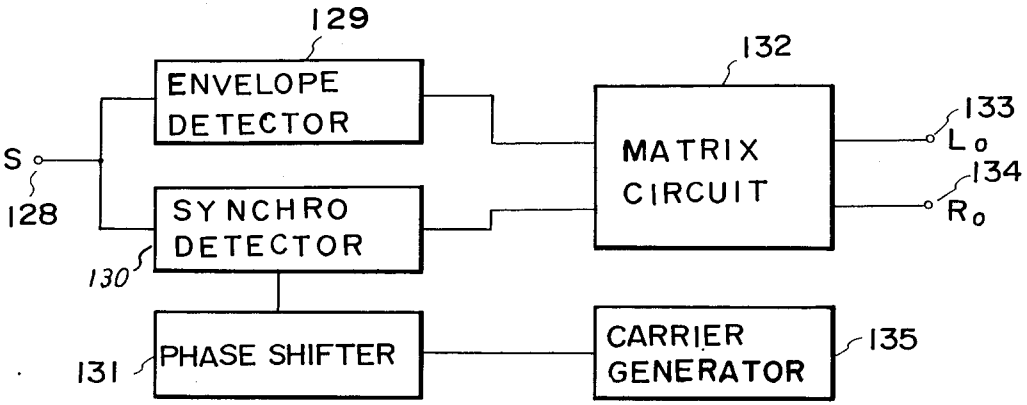

FIG. 11 shows a demodulator simplified in construction without using the amplitude controlleer. In the figure, 128 is the input terminal inputting the AM stereo signal S, 129 is the envelope detector, 130 is the synchro-detector, 135 is the carrier generator to generate a carrier for demodulation, 131 is the 90° phase shifter to shift the said carrier by 90°, 132 is the matrix circuit, and 133 and 134 are output coterminals for left and right audio signals $L_0$ and $R_0$.

When the frequency of the left and right audio signals L and R is low, the AM stereo signal inputted at the input terminal 128 is given by $$S=(1+L+R)\cos(\omega t+\phi), \tag{39}$$

and then the signal (1+L+R) is outputted from the envelope detector 129. The carrier generator 135 outputs a carrier cos $\omega t$ with the same phase as that of the input signal S, and the phase shifter 131 outputs a signal sin $\omega t$ with the phase shifted by 90° for the input signal S. The synchro-detector 130 which inputs the carrier sin $\omega t$ multiplies the said carrier sin $\omega t$ and the input signal S, and the high frequency part of the product signal is removed by a low-pass filter in the synchro-detector 130. Therefore, the output signal of the synchro-detector 130 is given by $$(1+L+R)\sin\phi=(L-R)\cos\phi. \tag{40}$$

In the matrix circuit 132, the output signal (1+L+R) of the envelope detector 129 and the said signal (L−R) cos $\phi$ are summed and subtracted, and then signals without DC part "1" are outputted. Therefore, the left and right signal $L_0$ and $R_0$ outputted from the output terminals 133 and 134 are given respectively by $$L_0=L(1+\cos\phi)+R(1-\cos\phi), \tag{41}$$

$$R_0=R(1+\cos\phi)+L(1-\cos\phi). \tag{42}$$

If cos $\phi$ is expanded in series until the second term approximately, equation (41) is written by $$L_0=2L\frac{(L-R)^3}{2(1+L+R)}, \tag{43}$$

$$\text{because of } \phi\approx\frac{L-R}{1+L+R}.$$

Note that $L_0$ is not equal to L and that there exists the second term in (43). However, the level of the second term of equation (43) is lower than that of the left audio signal L by −12 dB, and also, the average level of the difference signal (L−R) is very low generally. As a result, the second term of equation (43) has no effect practically. On the other hand, the output signal $R_0$ at the output terminal 134 is given similarly by $$R_0=2R+\frac{(L-R)^3}{2(1+L+R)}. \tag{44}$$

When the frequency of the left and right signals L and R is high, the AM stereo signal S inputted at the terminal 128 is given by $$S=\sqrt{(1+L+R)^2+(L-R)^2}\cos(\omega t+\phi). \tag{45}$$

Therefore, the output signals of the envelope detector 129 and the synchro-detector 130 are given, respectively, by $$\sqrt{(1+L+R)^2+(L-R)^2}, \tag{46}$$

$$(L-R) \tag{47}$$

Since the equation (46) is rewritten to (1+L+R) sec $\phi$ in which sec $\phi$ can be expanded in series until the second term, the equation (46) is approximately given by $$(1+L+R)(1+\phi^2/2). \tag{48}$$

In the matrix circuit 132, the signals represented by (47) and (48) are summed and subtracted with removal of DC part "1". Therefore, the left and right demodulated signals $L_0$ and $R_0$ which are outputted from output terminals 133 and 134 are given respectively by $$L=2L+\frac{(L^2-R^2)(L-R)}{2(1+L+R)}, \tag{49}$$

$$R=2R+\frac{(L^2-R^2)(L-R)}{2(1+L+R)}. \tag{50}$$

Figure 12:
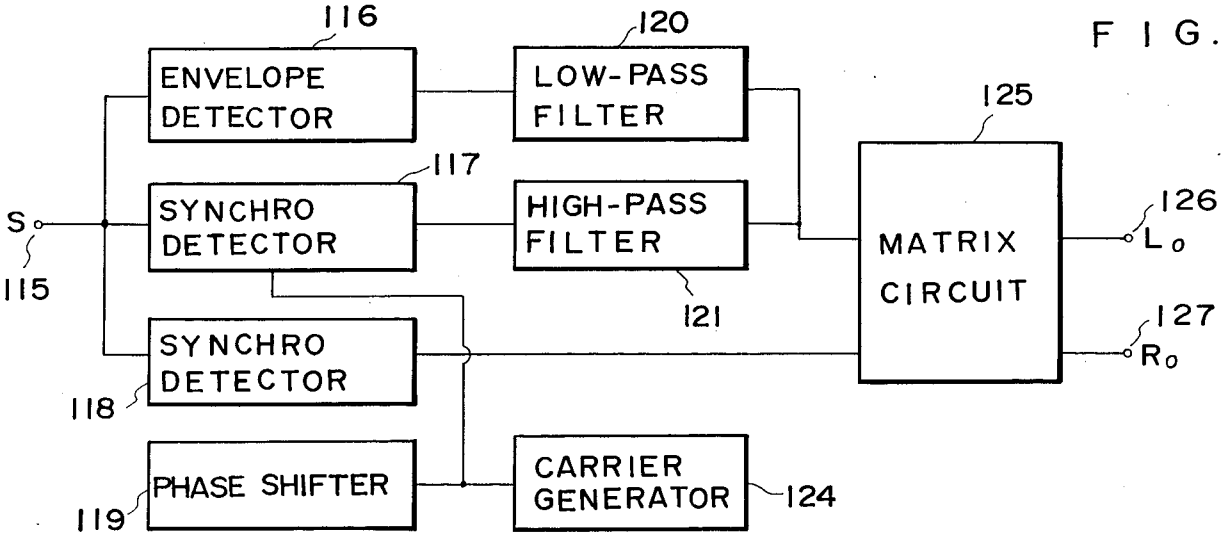
FIGS. 11 and 12 show demodulators simplified in construction without using the amplitude controller.

FIG. 12 shows another demodulator simplified in construction without using the amplitude controller.

When the frequency of the left and right audio signal L and R is low the signal S inputting at the input terminal 115 is expressed by equation (39). Therefore, the signal (1+L+R) is outputted from the envelope detector 116, the signal S is multiplied by the carrier cos $\omega t$ in the synchro-detector 117 to output (1+L+R). cos $\phi$ and also by the carrier sin $\omega t$ in the synchro-detector 118 to output (L−R) cos $\phi$. However, since the output signal of the synchro-detector 117 is removed by the high-pass filter 121, the matrix circuit performs sum and subtract operations between the output signal (1+L+R) passed through the low-pass filter 120 from the envelope detector 116 and the output signal (L−R) cos $\phi$ of the synchro-detector 118, and it outputs the signal without the DC part "1". Therefore, the left and right signals $L_0$ and $R_0$ outputted at the output terminals 126 and 127 are the same as those given by equations (43) and (44), respectively.

When the frequency of the left and right audio signals L and R is high, the signal S appearing at the input terminal 115 is expressed by (45). Therefore, the signals $\sqrt{(1+L+R)^2+(L-R)^2}$, (1+L+R) and (L−R) are outputted from the envelope detector 129, the synchro-detectors 117 and 118, respectively. Since the output signal of the envelope detector 116 is removed by the low-pass filter 120, the output signal (1+L+R) of the synchro-detector 117 passed through the high-pass filter and the output signal (L−R) of the synchro-detector 118 are summed and subtracted in the matrix circuit 125, and the signals in which the DC part "1" is removed are outputted. The left and right signals $L_0$ and $R_0$ outputted from the output terminals 126 and 127 are given respectively by $$L_0=2L, \quad (51)$$

$$R_0=2R. \quad (50)$$

and then the complete demodulation can be performed.

As described above, the AM stereo signals are demodulated with practically no problem practically though there exists some cross-talk and distortion. Consequently, according to examples shown in FIGS. 11 and 12, the demodulator can be constructed with a simple structure practically and the cost of materials and the production time are reduced.

According to the present invention, an audio signal of low frequency is transmitted using the following AM stereo signal:

$$S=(1+L+R)\cos(\omega t+\phi)$$

while an audio signal of high frequency is transmitted using the following AM stereo signal:

$$S=\sqrt{(1+L+R)^2+(L-R)^2}\cos(\omega t+\phi)$$

Therefore, the band occupied by side-lobe can be kept as narrow as that in the conventional AM broadcasting. In addition, broad-band broadcasting can be practiced. Further, no distortion is caused in the case of an audio signal of low frequency even when it is received by the conventional monaural receivers. Furthermore, distortion is caused in the case of an audio signal of high frequency, but most of its higher harmonics are present outside the band, thereby causing no problem in audibility. Still further, the band is narrow. Therefore, even when preemphasis is effected on the transmission side, little influence is exerted to its adjacent channels.

What is claimed:

1. A demodulator for AM stereo signals, comprising:

an amplitude controller for receiving an AM signal $S=A\cos(\omega t+\phi)$, wherein A represents an amplitude, $\omega$ a carrier angular frequency, and $\phi=\tan^{-1}(L-R)/1+L+R$ a phase angle;

an orthogonal demodulator for orthogonally demodulating the output of the amplitude controller;

a matrix circuit for deriving left and right audio signals L and R from sum and difference signals (L+R) and (L−R) obtained by the orthogonal demodulator;

an amplitude control signal generator circuit for producing a control signal to control the amplitude controller, and a low-pass filter for passing said control signal to said amplitude controller, wherein when the received AM stereo signal S is equal to (1+L+R) cos (t+$\phi$), the amplitude of the AM stereo signal S is changed by said amplitude controller in response to said control signal to $$\sqrt{(1+L+R)^2+(L-R)^2}\cos(\omega t+\phi).$$

2. An AM stereo signal demodulator as defined in claim 1, wherein said orthogonal demodulator comprises a PLL detection circuit for generating first and second carriers in accordance with a control signal, synchronously detecting the output of said amplitude controller in accordance with said first carrier to obtain one of said sum and difference signals, and generating said control signal in accordance with said one of said sum and difference signals, and synchronous detection means for synchronously detecting said amplitude controller output in accordance with said second carrier to obtain the other of said sum and difference signals.

3. An AM stereo signal demodulator as defined in claim 2, wherein said amplitude control signal generator comprises an envelope detector for detecting the envelope of the received AM signal, a comparator for comparing the output of said envelope detector with said other of said sum and difference signals, and a variable gain amplifier having its gain controlled in accordance with the output of said comparator.

4. An AM stereo signal demodulator as defined in claim 2, wherein said amplitude control signal generator circuit comprises a limiter for amplitude limiting the received AM signal, a multiplier for multiplying the amplitude limited signal with said second carrier, and a divider for dividing the received AM signal in accordance with the output of said multiplier.

5. An AM stereo transmission system, comprising:

a transmitter comprising: a matrix circuit for providing sum and difference signals (1+L+R) and (L−R) from the left and right audio signals L and R; an amplitude control signal generating circuit for producing an amplitude control signal cos $\phi$; a low-pass filter for passing the low frequency part of said amplitude control signal; first and second multipliers for multiplying said amplitude control signal cos $\phi$ by the respective outputs (1+L+R) and (L−R) of said matrix circuit; and an orthogonal modulator for orthogonally modulating the respective outputs of the said first and second multipliers to obtain the AM stereo signals $S=(1+L+R)\cos(\omega t+\phi)$ and $S=\sqrt{(1+L+R)^2+(L-R)^2}\cdot\cos(\omega t+\phi)$ for low and high audio frequencies, respectively; and a receiver comprising: an orthogonal demodulator for providing an output signal (1+L+R) cos $\phi$ and (L−R) cos $\phi$ for the received signal $S=(1+L+R)\cos(\omega t+\phi)$ and for providing an output signal (1+L+R) and (L−R) for the received signal $S=\sqrt{(1+L+R)^2+(L-R)^2}\cdot\cos(\omega t+\phi)$; an amplitude control signal generator circuit for producing an amplitude control signal cos $\phi$; a low-pass filter for passing the low frequency part of said amplitude control signal; first and second dividers for dividing the respectuve outputs (1+L+R)·cos $\phi$ and (L−R) cos $\phi$ by said amplitude control signal cos $\phi$; and a matrix circuit for outputting the left and right audio signals L and R by summing and subtracting the respective outputs of the first and second dividers, respectively.

6. An AM stereo system according to claim 5, wherein said first and second dividers in the receiver are located on the output side of the said matrix circuit.

7. An AM stereo demodulator comprising:

an envelope detector for detecting the envelope A of a received AM stereo signal $S=A\cos(\omega t+\phi)$;

a first synchronizing detector for synschronously detecting said signal S with a carrier sin $\omega t$;

a second synchronizing detector for synchronously detecting said signal S with a carrier cos $\omega t$;

a high-pass filter for passing the output of the said second synchronizing detector;

a low-pass filter for passing the output of the envelope detector; and a matrix circuit for providing the sum and difference between the output of said low-pass or high-pass filter and the output of said second synchronizing detector.

8. A modulator for AM stereo signals, comprising:

a matrix circuit for providing sum and difference signals (L+R) and (L−R) between left and right audio signals L and R;

an orthogonal modulator for orthogonally modulating and combining the sum and difference signals to produce an AM stereo signal $S=\sqrt{(1+L+R)^2+(L-R)^2}\cos(\omega t+\phi)$, wherein $\omega$ denotes a carrier angular frequency and $\phi=\tan^{-1}(L-R)/1+L+R$, denotes a phase angle, said orthogonal modulator comprising means for generating first and second orthogonal carriers, an amplitude modulator for amplitude modulating said first carrier in accordance with said sum signal, a balanced modulator for modulating said second carrier in accordance with said difference signal, and means for combining the modulated sum and difference signals to produce said AM stereo signal;

an amplitude control signal generator circuit for producing a control signal when the audio signal is in a low frequency band;

a low-pass filter for receiving said control signal and passing a filtered control signal; and an amplitude controller responsive to said filtered control signal for changing the amplitude of said AM stereo signal S to (1+L+R) cos $(\omega t+\phi)$ in the case of an audio signal in a low frequency band, said amplitude controller comprising a variable gain amplifier for amplifying the output of said means for combining in accordance with a control signal, and said amplitude control signal generator circuit comprises an envelope detector for detecting the envelope of an output of said variable gain amplifier, means responsive to said sum signal from said matrix circuit for producing a comparison signal representing (1+L+R) and comparison means for comparing said comparison signal with an output of said envelope detector to generate said control signal to said variable gain amplifier.

9. A modulator for AM stereo signals, comprising:

a matrix circuit for providing sum and difference signals (L+R) and (L−R) between left and right audio signals L and R;

an orthogonal modulator for orthogonally modulating and combining the sum and difference signals to produce an AM stereo signal $S=\sqrt{(1+L+R)^2+(L-R)^2}\cos(\omega t+\phi)$, wherein $\omega$ denotes a carrier angular frequency and $\phi=\tan^{-1}(L-R)/1+L+R$, denotes a phase angle, said orthogonal modulator comprising means for generating first and second orthogonal carriers, an amplitude modulator for amplitude modulating said first carrier in accordance with said sum signal, a balanced modulator for modulating said second carrier in accordance with said difference signal, and means for combining the modulated sum and difference signals to produce said AM stereo signal;

an amplitude control signal generator circuit for producing a control signal when the audio signal is in a low frequency band;

a low-pass filter for receiving said control signal and passing a filtered control signal; and an amplitude controller responsive to said filtered control signal for changing the amplitude of said AM stereo signal S to (1+L+R) cos $(\omega t+\phi)$ in the case of an audio signal in a low frequency band, said amplitude controller comprising a multiplier for multiplying an output of said means for combining in accordance with a control signal, an envelope detector for detecting an envelope of said AM stereo signal, means responsive to said sum signal for generating a signal representing (1+L+R) and divider means for dividing said representing signal (1+L+R) by said envelope detector output in order to generate said control signal to said multiplier.

* * * * *